US007456800B2

(12) United States Patent
Steghafner

(10) Patent No.: US 7,456,800 B2
(45) Date of Patent: Nov. 25, 2008

(54) RECEIVING ANTENNA SYSTEM COMPRISING SEVERAL ACTIVE ANTENNAE

(75) Inventor: Herbert Steghafner, Tiefenbach (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 0 days.

(21) Appl. No.: 10/577,411

(22) PCT Filed: Jul. 12, 2005

(86) PCT No.: PCT/EP2005/007554

§ 371 (c)(1),
(2), (4) Date: Jun. 20, 2007

(87) PCT Pub. No.: WO2006/018079

PCT Pub. Date: Feb. 23, 2006

(65) Prior Publication Data

US 2007/0268196 A1 Nov. 22, 2007

(30) Foreign Application Priority Data

Aug. 13, 2004 (DE) ..... 10 2004 039 439

(51) Int. Cl.
*H01Q 21/00* (2006.01)

(52) U.S. Cl. ..... 343/844; 343/850; 343/900; 343/901; 343/711

(58) Field of Classification Search ..... None
See application file for complete search history.

(56) References Cited

U.S. PATENT DOCUMENTS

| | | | | |
|---|---|---|---|---|
| 2,898,590 | A | 8/1959 | Pichitino et al. | 343/722 |
| 3,931,625 | A * | 1/1976 | Chiron et al. | 343/787 |
| 3,961,331 | A | 6/1976 | Campbell | 343/792 |
| 4,138,681 | A * | 2/1979 | Davidson et al. | 343/702 |
| 4,788,549 | A * | 11/1988 | Ohe et al. | 343/712 |
| 5,600,335 | A | 2/1997 | Abramo | 343/749 |
| 6,542,131 | B1 | 4/2003 | Haapanen | 343/813 |
| 6,570,544 | B2 * | 5/2003 | Yordy, Sr. | 343/844 |
| 6,917,340 | B2 | 7/2005 | Lindenmeier | 343/725 |

FOREIGN PATENT DOCUMENTS

| | | |
|---|---|---|
| DE | 34 37 727 C2 | 4/1986 |
| DE | 38 22 081 C2 | 1/1990 |
| EP | 1 093 187 A2 | 4/2001 |
| EP | 1 445 832 A2 | 8/2004 |
| WO | WO 01/71846 A1 | 9/2001 |

OTHER PUBLICATIONS

International Search Report in PCT/EP2005/007554 dated Oct. 13, 2005.

* cited by examiner

*Primary Examiner*—Trinh V Dinh
(74) *Attorney, Agent, or Firm*—Marshall, Gerstein & Borun LLP

(57) ABSTRACT

A receiver antenna system of broad bandwidth including a plurality of active, vertical individual antennae, which have an electrically-active antenna height adapted to the respective received frequency range, is minimized with regard to the mutual electromagnetic coupling between the individual antennae, which are positioned at a small spacing distance.

11 Claims, 4 Drawing Sheets

RECEIVING ANTENNA SYSTEM COMPRISING SEVERAL ACTIVE ANTENNAE

BACKGROUND OF THE INVENTION

1. Field of the Invention

The invention relates to a receiver antenna system with several active antennae.

2. Description of Related Technology

Between the passive antenna structure and the active electronic elements, such as impedance converters and amplifier elements, active receiver antennae do not have interfaces with a constant surge impedance. In the case of passive antennae, the surge impedance of these interfaces must be adapted in the useful frequency range to the surge impedance of a normal line. This therefore reduces the bandwidth of the receiver antenna system as a whole in an undesirable manner.

If an antenna system is formed from several, active individual antennae, of which the respective electrical antenna height is adapted to the respective received frequency range of the individual antenna, in order to avoid deformed antenna patterns—"peaked antenna patterns"—, a broad-band, overall received-frequency range of the receiver antenna system built up from the several individual receiver-frequency ranges of the individual antennae can be achieved. The shortening of the electrical antenna height of the individual antenna can be implemented electrically by arranging impedance elements, for example, a parallel circuit consisting of an inductance and an ohmic resistor at given heights of the individual antenna. At low received frequencies, the inductance bridges the resistor, while the resistor is active at high received frequencies. It is therefore possible to adjust the electrical antenna height to the respective received frequency range of the individual antenna by an exact positioning of the impedance elements and a received-frequency-dependent parametrisation of the impedance elements.

A receiver antenna system including several active individual antennae is disclosed in DE 34 37 727 A1. With the disclosed receiver antenna system, the individual antennae are positioned at relatively large spacing distances—up to a few hundred meters—from one another. The mutual electromagnetic couplings of the individual antennae, which impair the directivity, the efficiency and the antenna power gain of the receiver antenna system, are negligible with an arrangement of this kind. However, if a considerably more compact realization of a receiver antenna system is required with spacing distances between the individual antennae in the order of magnitude of a few centimetres, these mutual, electromagnetic couplings of the individual antennae are no longer negligible. In a disadvantageous manner, they lead to deformed antenna patterns of the individual antennae, to a mutual, negative influence on the base-point impedances and to unsymmetrical stresses on the individual antennae, which has the overall effect of impairing the quality of reception of the receiver antenna system.

SUMMARY OF THE INVENTION

The invention therefore provides a receiver antenna system with several active individual antennae with a small spacing distance, which provides a broad bandwidth.

More particularly, the invention provides a receiver antenna system of broad bandwidth including several active, vertical individual antennae ($\mathbf{2}_1, \mathbf{2}_2, \ldots, \mathbf{2}_N$) with an electrically-active antenna height adapted to the respective received frequency range, characterized wherein the mutual electromagnetic coupling between the individual antennae ($\mathbf{2}_1, \mathbf{2}_2, \ldots, \mathbf{2}_N$), which are positioned at a small spacing distance, is minimized.

In order to suppress the above-named, disadvantageous effects, the currents in the individual antennae are decoupled from the electromagnetic couplings by the individual current-influencing parameters of the receiver antenna system in a received-frequency-dependent manner. The individual antennae of the receiver antenna system according to the invention are therefore designed by optimizing the current-influencing parameters of the receiver antenna system—frequency-dependent electrical antenna height (impedance elements on the radiators), antenna diameter, antenna spacing distances and input impedance of the active base-point electronics—in order to minimise the electromagnetic couplings of the individual antennae.

In this context, particular attention is paid to the arrangement of impedance elements within an individual antenna and also to the arrangement of the impedance elements between the individual antennae, which determine the respective, electrically-active antenna height of the individual antenna in a reception-frequency-dependent manner.

Additionally, through appropriate dimensioning of the input impedances of the individual base-point electronics, also outside the useful frequency range of the respective individual antenna, a targeted influence on the electromagnetic couplings between the individual antennae and an optimization of the efficiency of the overall arrangement is achieved.

The active individual antennae optimized in this manner are connected via phase matching networks for phase matching of the transmission signals received in the individual antennae with a frequency crossover network for combining the individual phase-matched received signals.

BRIEF DESCRIPTION OF THE DRAWINGS

The embodiment of the receiver antenna system with several active individual antennae is explained in greater detail below with reference to the drawings. The drawings are as follows.

DETAILED DESCRIPTION

Figure 1:
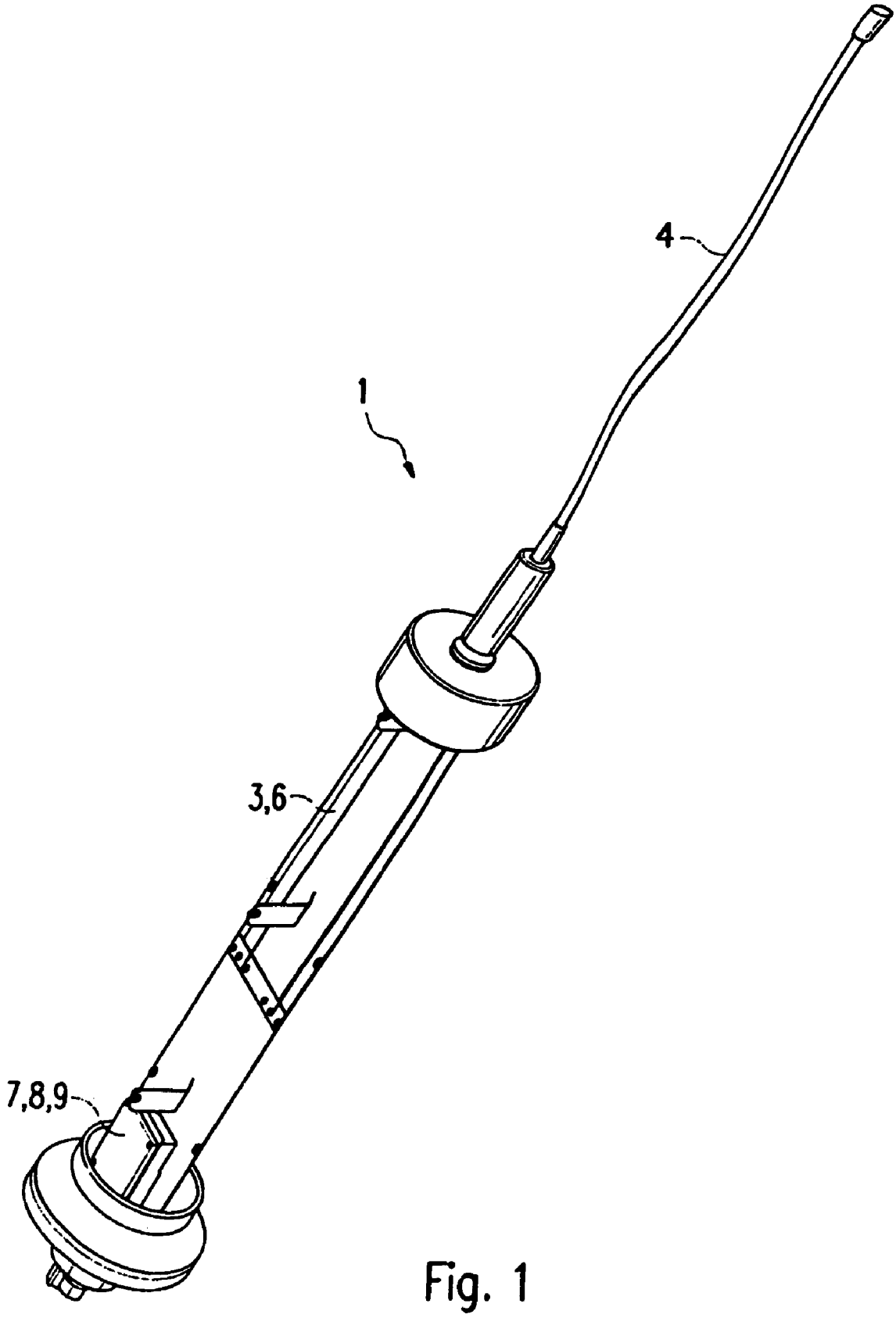
FIG. 1 shows a three-dimensional view of the receiver antenna system according to the invention.
Figure 2:
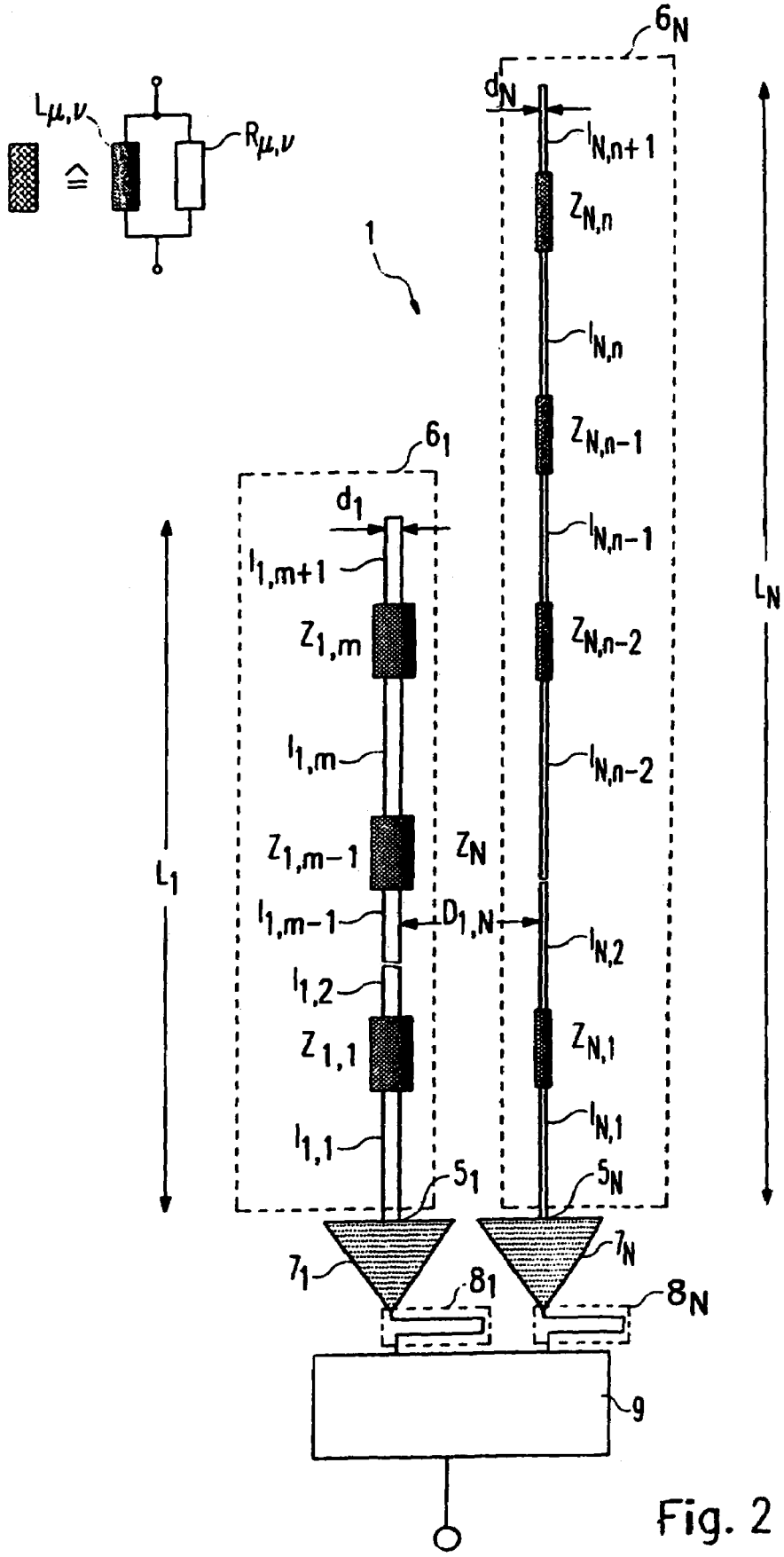
FIG. 2 shows in outline an arrangement of the receiver antenna system according to the invention.

The receiver antenna system according to the invention as shown in FIG. 1 and FIG. 2 includes several individual antennae $\mathbf{2}_1, \mathbf{2}_2, \ldots, \mathbf{2}_N$, in the minimal configuration, two individual antennae $\mathbf{2}_1$ and $\mathbf{2}_2$. These individual antennae $\mathbf{2}_1, \mathbf{2}_2, \ldots, \mathbf{2}_N$ are attached to a printed circuit board 3 as printed conductors. The antenna receiver system 1 has an extension 4 for the individual antenna with the largest mechanical antenna height, which receives the long-wave transmission signal. For protection, the printed-circuit board 3 with the individual antennae $\mathbf{2}_1, \mathbf{2}_2, \ldots, \mathbf{2}_N$ is enclosed within a synthetic-material tube.

Each individual antenna $\mathbf{2}_1, \mathbf{2}_2, \ldots, \mathbf{2}_N$, has respectively a mechanical antenna height $L_1, L_2, \ldots, L_N$ and an antenna diameter $d_1, d_2, \ldots, d_N$. The individual antennae $\mathbf{2}_1, \mathbf{2}_2, \ldots,$ $2_N$, each provide several printed-conductor portions $1_{\mu,\nu}$, which are connected to one another via impedance elements $Z_{\mu,\nu}$. For example, the individual antenna $2_1$ in FIG. 2 provides printed-conductor portions $1_{1,1}$, $1_{1,2}$, . . . , $1_{1,m-1}$, $1_{1,m}$ and $1_{1,m+1}$, and the intermittent impedance elements $Z_{1,1}$, . . . , $Z_{1,m-1}$ and $Z_{1,m}$, while the individual antenna $2_N$ consists of the printed-conductor portions $1_{N,1}$, $1_{N,2}$, . . . , $1_{N,n-2}$, $1_{N,n-1}$, $1_{N,n}$, and $1_{N,n+1}$, and the intermittent impedance elements $Z_{N,1}$, . . . , $Z_{N,n-2,\ ZN,n-1}$ and $Z_{N,n}$.

The individual impedance elements $Z_{\mu,\nu}$ consist of a circuit, which provides a very low impedance value with low received frequencies, and which, in the ideal case of a received frequency converging towards zero, short circuits the two adjacent printed-conductor portions $1_{\mu,\nu}$ and $1_{\mu,\nu+1}$. By contrast, with high received frequencies, the circuit provides a high real component of the impedance, which, in the ideal case of an infinitely high received frequency, as a pure resistor, suppresses the current flow between the adjacent printed-conductor portions $1_{\mu,\nu}$ and $1_{\mu,\nu+1}$ and therefore reduces the electrically-active antenna height of the individual antenna $2_\mu$. In this manner, it is possible, through corresponding parametrization of all impedance elements $Z_{\mu,\nu}$ associated with the respective individual antenna $2_\mu$ and their positioning on the individual antenna $2_\mu$, to adjust the electrically-active antenna height of the respective individual antenna $2_\mu$ to the optimum antenna height for the respective frequency range of the individual antenna $2_\mu$. In order to realize a frequency-dependent impedance characteristic of this kind, the individual impedance elements $Z_{\mu,\nu}$ are realised, for example, in a known manner, by a parallel circuit with an inductance $L_{\mu,\nu}$ and an ohmic resistor $R_{\mu,\nu}$. These impedance elements $Z_{\mu,\nu}$ can be distributed on the individual antennae $2_1$, $2_2$, . . . , $2_N$ either in a discrete manner or continuously as correspondingly-formed printed conductors.

The respective individual antennae $2_\mu$ and $2_\nu$ are arranged on the printed-circuit board 3 with a spacing distance of $D_{\mu,\nu}$, which is typically a few centimeters. The respective base-points $5_1$, $5_2$, . . . , $5_N$ of the respective passive antenna regions $6_1$, $6_2$, . . . , $6_N$ of the individual antennae $2_1$, $2_2$, . . . , $2_N$ are electrically coupled to the active base-point electronics $7_1$, $7_2$, . . . , $7_N$, for example, amplifier elements and/or impedance converters. The passive antenna regions $6_1$, $6_2$, . . . , $6_N$ can be designed in all radiator structures, such as monopoles, dipoles etc.

Impedance conversion, amplification and coarse filtering—through the frequency response of the respective individual antenna—of the transmission signals received respectively in the passive antenna regions $6_1$, $6_2$, . . . , $6_N$ of the individual antennae $2_1$, $2_2$, . . . , $2_N$, are implemented in the base-point electronics $7_1$, $7_2$, . . . , $7_N$.

After their impedance conversion, amplification and filtering in the respective base-point electronics $7_1$, $7_2$, . . . , $7_N$, the received transmission signals are phase-matched in the subsequent phase matching networks $8_1$, $8_2$, . . . , $8_N$, especially in the overlapping range of the filters of the frequency crossover network of the individual adjacent or overlapping received frequency ranges, in order to guarantee an addition instead of a subtraction of the individual received transmission signals. The phase matching in the individual phase matching networks $8_1$, $8_2$, . . . , $8_N$ is optimized to such an extent that the maximum possible phase deviation of two received transmission signals is 90°.

After the phase matching in the phase matching networks $8_1$, $8_2$, . . . , $8_N$, a band limitation and combination of the individual transmission signals received in the individual antennae $2_1$, $2_2$, . . . , $2_N$ to form a single overall received signal, which provides an overall reception bandwidth, which corresponds to the sum of all of the individual partial received frequency ranges of the individual antennae $2_1$, $2_2$, . . . , $2_N$, takes place in the subsequent frequency crossover network 9.

Figure 3:
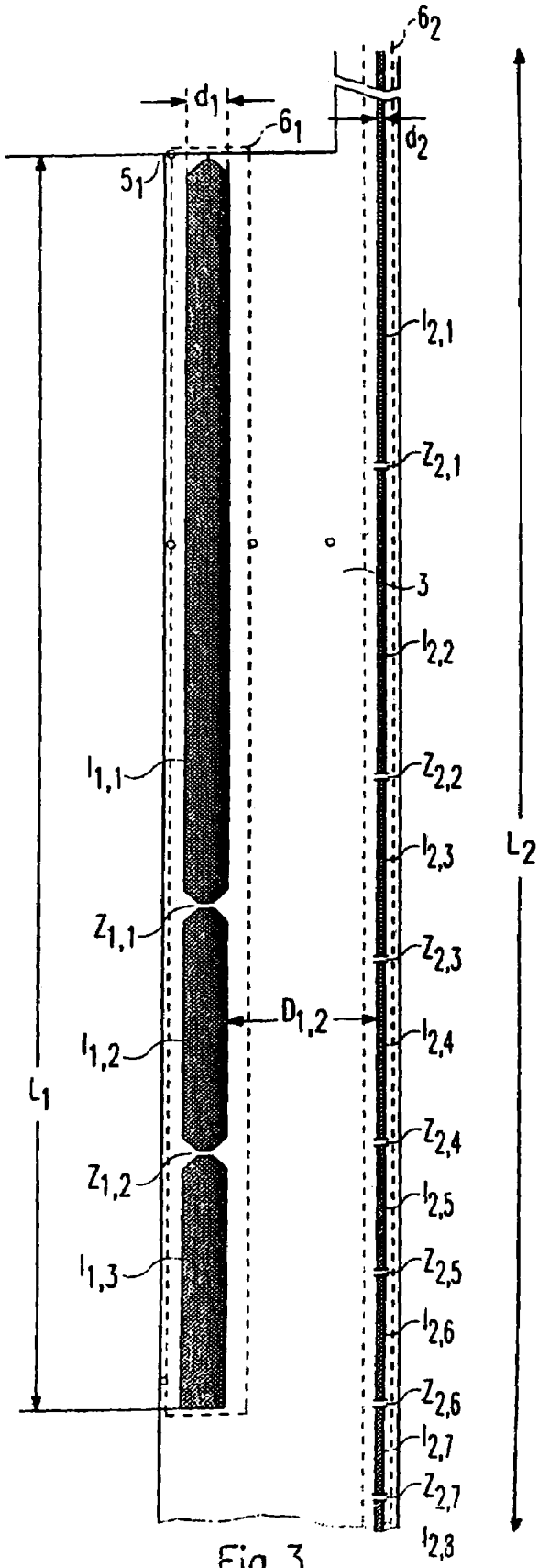
FIG. 3 shows a plan view of the geometry of the passive antenna region of the receiver antenna system according to the invention and FIG. 4 shows an electrical, block circuit diagram of the receiver antenna system according to the invention.

In FIG. 3, in order to visualise the geometric antenna optimization, a portion of the two passive antenna regions $6_1$ and $6_2$ printed on a printed-circuit board 3 of the individual antennae $2_1$ and $2_2$ of the minimal configuration of a receiver antenna system 1 is illustrated for a lower and an upper partial received frequency range respectively. They consist in each case of the printed-conductor portions $1_{1,1}$, $1_{1,2}$, and $1_{1,3}$ and $1_{2,1}$, $1_{2,2}$, $1_{2,3}$, $1_{2,4}$, $1_{2,5}$, $1_{2,6}$, $1_{2,7}$, $1_{2,8}$ etc. and the intermittent impedance elements $Z_{1,1}$, and $Z_{1,2}$, and $Z_{2,1}$, $Z_{2,2}$, $Z_{2,3}$, $Z_{2,4}$, $Z_{2,5}$, $Z_{2,6}$, $Z_{2,7}$, ect., which are shown in FIG. 3 not in their concrete interconnection but as free space relative to their positioning. The optimization of the passive antenna regions $6_1$ and $6_2$ of the individual antennae $2_1$ and $2_2$ in order to minimize the electromagnetic couplings takes place through an optimum design of the antenna diameters $d_1$ and $d_2$, the spacing distance $D_{1,2}$ between the two individual antennae $2_1$ and $2_2$, the position of the individual impedance elements $Z_{\mu,\nu}$ relative to one another within the respective individual antennae $2_1$ and $2_2$ and between the two individual antennae $2_1$ and $2_2$.

It is evident from FIG. 3 that, according to the invention, with a larger spacing distance relative to the base-points $5_1$ and $5_2$, the printed-conductor portions $1_{82\ ,\nu}$ are increasingly shorter in length. Moreover, it is evident that the length $L_1$ of the individual antenna $2_1$ for the reception of relatively high-frequency transmission signals is designed to be shorter than the length $L_2$ of the individual antenna $2_2$ for the reception of low-frequency transmission signals. Finally, the antenna diameter $d_1$ of the individual antenna $2_1$ for the reception of relatively higher-frequency transmission signals is designed according to the invention to be significantly greater than the antenna diameter $d_2$ of the individual antenna $2_2$ for the reception of relatively low-frequency transmission signals.

Figure 4:
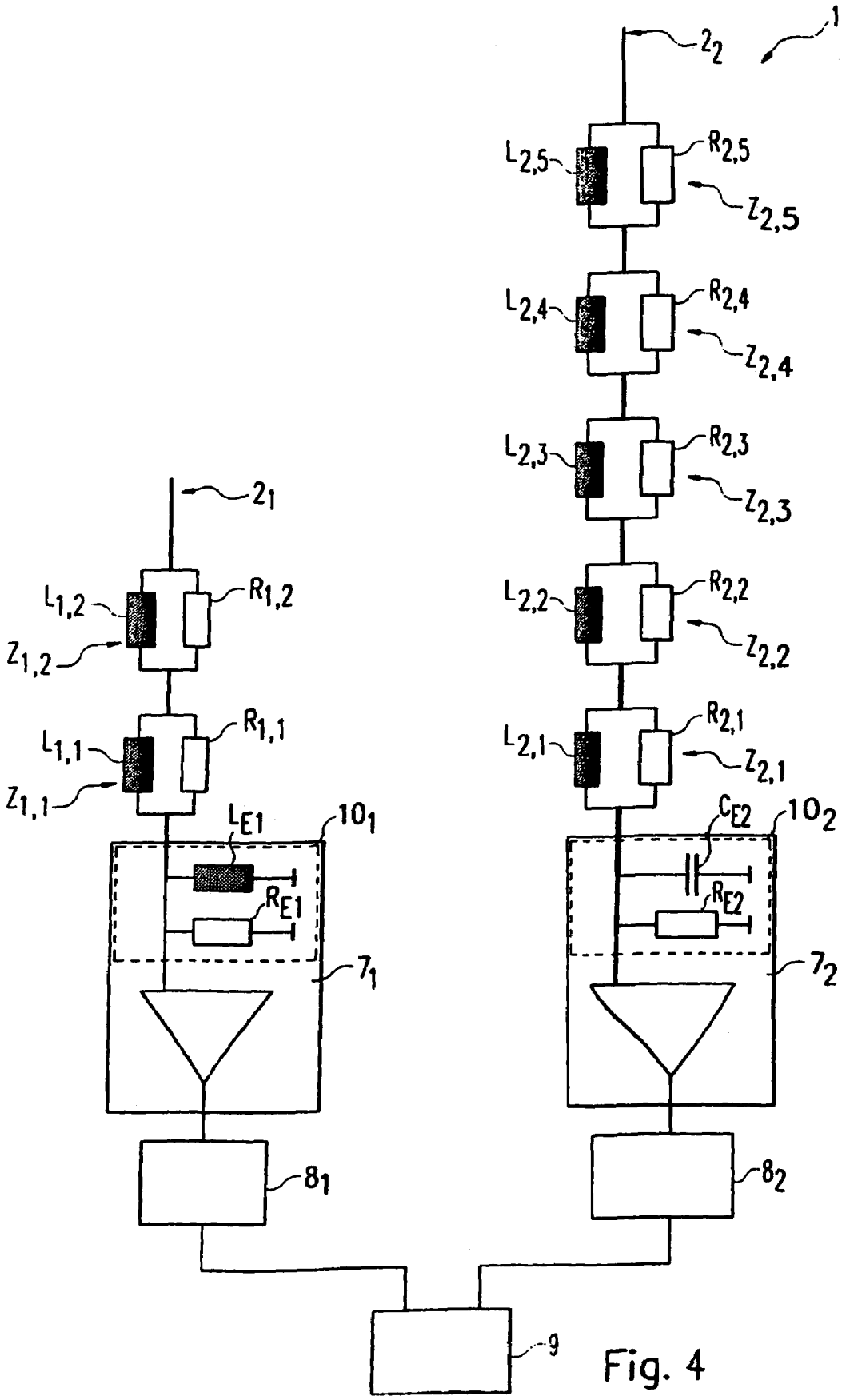

In FIG. 4, in order to visualise the electrical optimization, the minimum configuration of the individual antennae from FIG. 3 is presented with the individual antenna $2_1$ for the reception of high-frequency transmission signals and the individual antenna $2_2$ for the reception of relatively low-frequency transmission signals. According to the invention, the input impedance of the base-point electronics $7_1$ of the individual antenna $2_1$, which provides a shorter antenna height for reception in the upper frequency range, has a lower value with lower received frequencies. In this manner, low-frequency currents in the individual antenna $2_1$ are conducted with low resistance to earth at the input of the base-point electronic $7_1$, so that the low-frequency currents coupled from the individual antenna $2_2$ to the individual antenna $2_1$ do not generate unnecessary losses in the input impedance $10_1$ of the base-point electronics $7_1$ thereby impairing the efficiency of the antenna $2_2$ and do not therefore have a negative influence on the individual antenna $2_2$ through electromagnetic parasitic coupling with the adjacent individual antenna $2_1$. In order to realise a small input impedance of the base-point electronics $7_1$ with low-frequency received signals, a parallel circuit consisting of an inductance $L_{E1}$ and an ohmic resistor $R_{E1}$ is used as the input impedance $10_1$ of the base-point electronics. With higher-frequency received signals, the input impedance $10_1$ of the base-point electronics $7_1$ provides an input impedance matched to the passive antenna structure.

It is also evident from FIG. 4 that the inductances $L_{2,\nu}$ in the individual impedance elements $Z_{2,\nu}$ become high-resistance on receiving relatively high-frequency transmission signals, and in combination with the resistors on the individual printed-conductor portions $1_{2,\nu}$ of the individual antenna $2_2$, behave like a ferritized conductor. Accordingly, relatively high-frequency currents on the individual antenna $\mathbf{2}_2$ are suppressed. As a result, there is no coupling with the adjacent individual antenna $\mathbf{2}_1$. With low-frequency received signals, the inductances $L_{2,\nu}$ of the impedance elements $Z_{2,\nu}$ of the individual antenna $\mathbf{2}_2$ are of low resistance and do not lead to a suppression of the currents on the individual printed-conductor portions $\mathbf{1}_{2,\nu}$ of the individual antenna $\mathbf{2}_2$. In the overall operating-frequency range, the input impedance $\mathbf{10}_2$ of the base-point electronic $\mathbf{7}_2$ provides a high-resistance, capacitive input impedance. The input impedance $\mathbf{10}_2$ consists of a parallel circuit with a high-resistance resistor $R_{E2}$ and a capacitor $C_{E2}$ with very small capacity.

In general, it can be stated that all of the impedance elements $Z_{1,\nu}$ in the individual antenna $\mathbf{2}_1$ and all of the impedance elements $Z_{2,\nu}$ in the individual antenna $\mathbf{2}_2$ not only perform the function of the frequency-dependent electrical shortening of the respective antenna height, but, by variation of their impedance $Z_{1,\nu}$ on the individual antenna $\mathbf{2}_1$, influence the current $I_1$ in the individual antenna $\mathbf{2}_1$ in a targeted, frequency-dependent manner, and, by variation of their impedance $Z_{2,\nu}$ on the individual antenna $\mathbf{2}_2$, influence the current $I_2$ on the individual antenna $\mathbf{2}_2$ in a targeted, frequency-dependent manner, and accordingly also minimize the extent of coupling between the two individual antennae $\mathbf{2}_1$ and $\mathbf{2}_2$ in a targeted manner.

Alongside the above-named designs, the input impedances $\mathbf{10}_1, \mathbf{10}_2, \ldots, \mathbf{10}_N$ of the base-point electronics $\mathbf{7}_1, \mathbf{7}_2, \ldots, \mathbf{7}_N$ are additionally mismatched relative to the base-point impedance of the respective passive antenna regions $\mathbf{6}_1, \mathbf{6}_2, \ldots, \mathbf{6}_N$ of the individual antennae $\mathbf{2}_1, \mathbf{2}_2, \ldots, \mathbf{2}_N$ preferably outside the useful frequency range of the individual antenna. In this manner, targeted reflections occur at the inputs of the base-point electronics $\mathbf{7}_1, \mathbf{7}_2, \ldots, \mathbf{7}_N$, which have the overall effect of minimizing the electromagnetic couplings between the individual antennae $\mathbf{2}_1, \mathbf{2}_2, \ldots, \mathbf{2}_N$.

The invention is not limited to the embodiment presented. In particular, the invention also covers different antenna geometries, different interconnections of the impedance elements and different input interconnections of the base-point electronics.

The invention claimed is:

1. A receiver antenna system of broad bandwidth comprising:

a plurality of active, vertical individual antennae each with an electrically-active antenna height adapted to a respective received frequency range, wherein:

the mutual electromagnetic coupling between the individual antennae, which are positioned at a small spacing distance, is minimized, by optimization of individual mechanical and electrically-active antenna heights, individual antenna diameters, spacing distances between individual antennae, and the input impedances of active base-point electronics disposed at respective base points associated with the individual active antennae, wherein in each of the individual antennae, the electrically-active antenna height is optimized by an arrangement of conductor portions disposed along a vertical length of the antenna wherein one of a plurality of impedance elements is disposed between each consecutive pair of conductor portions, the optimized arrangement of the impedance elements relative to one another takes place both within one of the individual antennae and also between the individual antennae, and the length of each subsequent conductor portion of each individual antenna decreases with increasing distance of the conductor portion from a base point located at an open end of the antenna.

2. Receiver antenna system according to claim 1, wherein the interconnection of the impedance elements provides a low impedance in the case of low received frequencies, and provides a high impedance in the case of high received frequencies.

3. Receiver antenna system according to claim 2, wherein the interconnection of the impedance elements comprises a parallel circuit comprising an inductance and an ohmic resistor or annular or tubular ferrite cores fitted onto printed conductor portions.

4. Receiver antenna system according to 1, wherein the input impedance of the active base-point electronics provides a high-resistance input impedance in those of the individual antennae, which are determined for the reception of low-frequency transmission signals.

5. Receiver antenna system according to claim 4, wherein the input impedance of the active base-point electronics comprises a parallel circuit comprising a high-resistance resistor and a low-capacity capacitor in those of the individual antennae, which are determined for the reception of low-frequency transmission signals.

6. Receiver antenna system according to 4, wherein the input impedance of the active base-point electronics is additionally mismatched in a targeted manner.

7. Receiver antenna system according to claim 6, wherein the input impedance of the active base-point electronics is additionally mismatched in a targeted manner outside the useful frequency range to the base-point impedance of the passive antenna region of the respective individual antenna.

8. Receiver antenna system according to claim 1, wherein the input impedance of the active base-point electronics in those of the individual antennae, which are determined for the reception of relatively high-frequency transmission signals, is designed to be of low-resistance for low-frequency transmission signals and to be at the base-point impedance of the passive antenna region of the respective individual antenna for relatively high-frequency transmission signals.

9. Receiver antenna system according to claim 8, wherein the input impedance of the active base-point electronics in those of the individual antennae, which are determined for the reception of relatively high-frequency transmission signals, comprises a parallel circuit comprising a resistor and an inductance.

10. Receiver antenna system according to wherein 1, wherein the received frequency ranges of the individual antennae adjoin one another and form a complete received frequency range.

11. Receiver antenna system according to claim 10, wherein phase matching networks for phase matching of the received transmission signals and a crossover network for combining individual received transmission signals are connected to passive antenna regions for the reception of transmission signals and to the base-point electronics for the amplification and filtering of the received transmission signals.

* * * * *